US006176043B1

(12) United States Patent
Gibbs

(10) Patent No.: US 6,176,043 B1
(45) Date of Patent: Jan. 23, 2001

(54) PVC GATE FRAMING SYSTEM

(76) Inventor: Edward L. Gibbs, P.O. Box 581000, Tulsa, OK (US) 74158-1000

( * ) Notice: Under 35 U.S.C. 154(b), the term of this patent shall be extended for 0 days.

(21) Appl. No.: 09/231,097

(22) Filed: Jan. 14, 1999

(51) Int. Cl.[7] ..... E06B 3/00; E06B 3/78; E04C 5/08

(52) U.S. Cl. ..... 49/501; 49/449; 52/223.6

(58) Field of Search ..... 49/501, 449; 292/238; 256/73, 19; 52/223.6, 223.7

(56) References Cited

U.S. PATENT DOCUMENTS

| | | | | |
|---|---|---|---|---|
| 276,333 | * | 4/1883 | Baldwin | 292/238 |
| 772,996 | * | 10/1904 | Allsup | 256/73 |
| 1,597,856 | * | 8/1926 | Atkinson | 292/238 |
| 2,092,411 | * | 9/1937 | Anderson | 52/223.6 |
| 2,334,426 | * | 11/1943 | McCulloch | 292/238 |
| 3,286,424 | * | 11/1966 | Weyant | 52/291 |
| 3,299,596 | * | 1/1967 | Neal et al. | 52/476 |
| 3,893,273 | * | 7/1975 | Sailor | 52/291 |
| 4,118,827 | * | 10/1978 | Yamamoto | 16/252 |
| 4,403,452 | * | 9/1983 | Urbanick | 49/501 |
| 4,722,514 | * | 2/1988 | Pettit | 256/50 |
| 4,726,163 | * | 2/1988 | Jacobs | 52/223.6 |
| 4,871,203 | * | 10/1989 | Rogers | 292/238 |
| 5,628,149 | * | 5/1997 | Kraczek | 49/396 |
| 5,716,041 | * | 2/1998 | Groves | 256/73 |
| 5,938,184 | * | 8/1999 | DeSouza | 256/19 |

FOREIGN PATENT DOCUMENTS

| | | | | |
|---|---|---|---|---|
| 71606 | * | 9/1915 | (AT) | 49/501 |
| 35610 | * | 10/1966 | (FI) | 49/501 |
| 384085 | * | 3/1908 | (FR) | 256/73 |
| 591608 | * | 7/1925 | (FR) | 49/501 |
| 111386 | * | 11/1917 | (GB) | 256/73 |
| 300711 | * | 11/1928 | (GB) | 256/73 |
| 2235225 | * | 2/1991 | (GB) | 256/73 |
| 2241284 | * | 8/1991 | (GB) | 49/501 |
| 10047 | * | 10/1992 | (GB) | 292/238 |

* cited by examiner

*Primary Examiner*—Daniel P. Stodola
*Assistant Examiner*—Gregory J. Strimbu
(74) *Attorney, Agent, or Firm*—William S. Dorman

(57) ABSTRACT

A gate framing system for a PVC gate, the gate comprising first and second spaced vertical PVC frame members connected at their upper and lower ends to a pair of spaced horizontal PVC frame members, the gate framing system comprising a pair of spaced metallic framing brackets mounted at each corner of the PVC gate, the pairs of framing brackets being connected to each other in such manner as to hold the PVC gate in compression between the brackets at each corner thereof, wherein the framing brackets are bent around the outer side edges of the PVC vertical frame members in an overlapping relation, wherein a first post-tensioning metallic rod extends horizontally across the top of the PVC gate through the overlapping ends of the pairs of brackets at the upper corners of the PVC gate, and wherein a second post-tensioning metallic rod extends horizontally across the bottom of the PVC gate through the overlapping ends of the pairs of framing brackets at the bottom corners of the PVC gate, whereby the post-tensioning rods exert horizontal compressive forces between the upper two corners and the lower two corners to add structural rigidity to the PVC gate.

6 Claims, 6 Drawing Sheets

PVC GATE FRAMING SYSTEM

BACKGROUND OF THE INVENTION

1. Field of the Invention

This invention relates to PVC gates and, more particularly, to a framing system for the gates.

2. Prior Art

Recent trends in the fencing industry have demonstrated that PVC fences and gates have begun to replace the more conventional wooden and metallic fences and gates for some purposes.

One of the problems with PVC gates, for example, arises when the user or installer attempts to attach metallic parts directly to the PVC material. In many instances, there is a tendency for the screws to tear out of the PVC material.

The present invention, on the other hand, provides a framing system wherein certain portions of the PVC gate are sandwiched and compressed between stainless steel framing brackets to which the hardware elements, such as hinge straps, are attached directly, thereby obviating, in that particular case, a direct connection between the hinge strap and the PVC material.

SUMMARY OF THE INVENTION

The present invention provides a metallic framing system, preferably of stainless steel, for a plastic gate, preferably of poly vinyl chloride (hereinafter PVC). The PVC gate is formed from a pair of spaced vertical PVC frame members connected at their upper and lower ends to a pair of spaced horizontal PVC frame members, thereby forming four corners on the PVC gate. The gate is further defined as having a front side and a rear side. A pair of L shaped metallic framing brackets are mounted at each corner of the PVC gate such that one framing bracket at each corner lies along the rear side of the PVC gate and one framing bracket lies opposite the last mentioned framing bracket along the front side of the PVC gate. The pairs of framing brackets are adapted to embrace the vertical PVC frame member and the adjacent portion of the horizontal PVC frame member and further hold the PVC gate in compression between the framing brackets at each corner.

The PVC gate is disposed between two PVC gate posts which are generally of considerably larger size than the PVC frame members of the gate. On one of the PVC gate posts (hereinafter referred to as the hinge post) are located a pair of right angled hinge elements each of which is connected to two sides of the hinge post. Each right angled member has a pair of ears on the side adjacent the PVC gate which support a pivot pin. The composite hinge also includes a hinge strap which is adapted to connect directly to one of the stainless steel framing brackets on the front side of the gate, preferably the uppermost and lowermost framing brackets. Each framing bracket to which a hinge strap is connected is provided with a pair of bolts that are welded to the inside of the framing bracket and which extend forward and through a pair of holes in the hinge strap.

The holes in the hinge strap are slotted so as to provide adjustability of the gate with respect to the hinge post. The ends of the hinge straps are bent and further provided with curved ends in which the hinge pins are received. The relationship between the hinge straps, the PVC gate and the hinge post is such that the gate can rotate through a 180 degree arc.

Also, the hinge strap is not connected directly to the PVC portions but rather to one of the hinge brackets between which the PVC gate is compressed.

On the opposite side of the PVC gate from the hinge post is a second PVC post, hereinafter referred to as the latch post. Mounted on the latch post are a back plate and pivotal latch member which are similar in some respects to the latch shown in U.S. Pat. No. 4,871,203 issued on Oct. 3, 1989 to Gerald H. Rogers. For the purpose of providing a striker bar which will cooperate with the latch mechanism mounted on the latch post, an intermediate horizontal PVC frame member is provided to extend between the two vertical PVC frame members. At the position where the intermediate horizontal PVC frame member connects with the vertical PVC frame member adjacent the latch post, another pair of framing members are provided so as to compress the PVC gate in the region of this connection between the intermediate horizontal PVC frame member and the vertical frame member. A U shaped striker support member is connected to the forward intermediate framing bracket in much the same manner that the hinge straps are connected to their associated framing brackets. A striker bar is mounted on the ends of the U shaped striker bar support so that it is positioned and spaced in parallel relation with the forward face of the PVC gate. The outer end of the striker bar extends slightly beyond the adjacent edge of the latch post and is adapted to engage complementary openings in the back plate and in the pivotal latch member. The striker bar thus serves as a handle for opening and closing the gate.

DETAILED DESCRIPTION OF THE PREFERRED EMBODIMENTS

Figure 1:
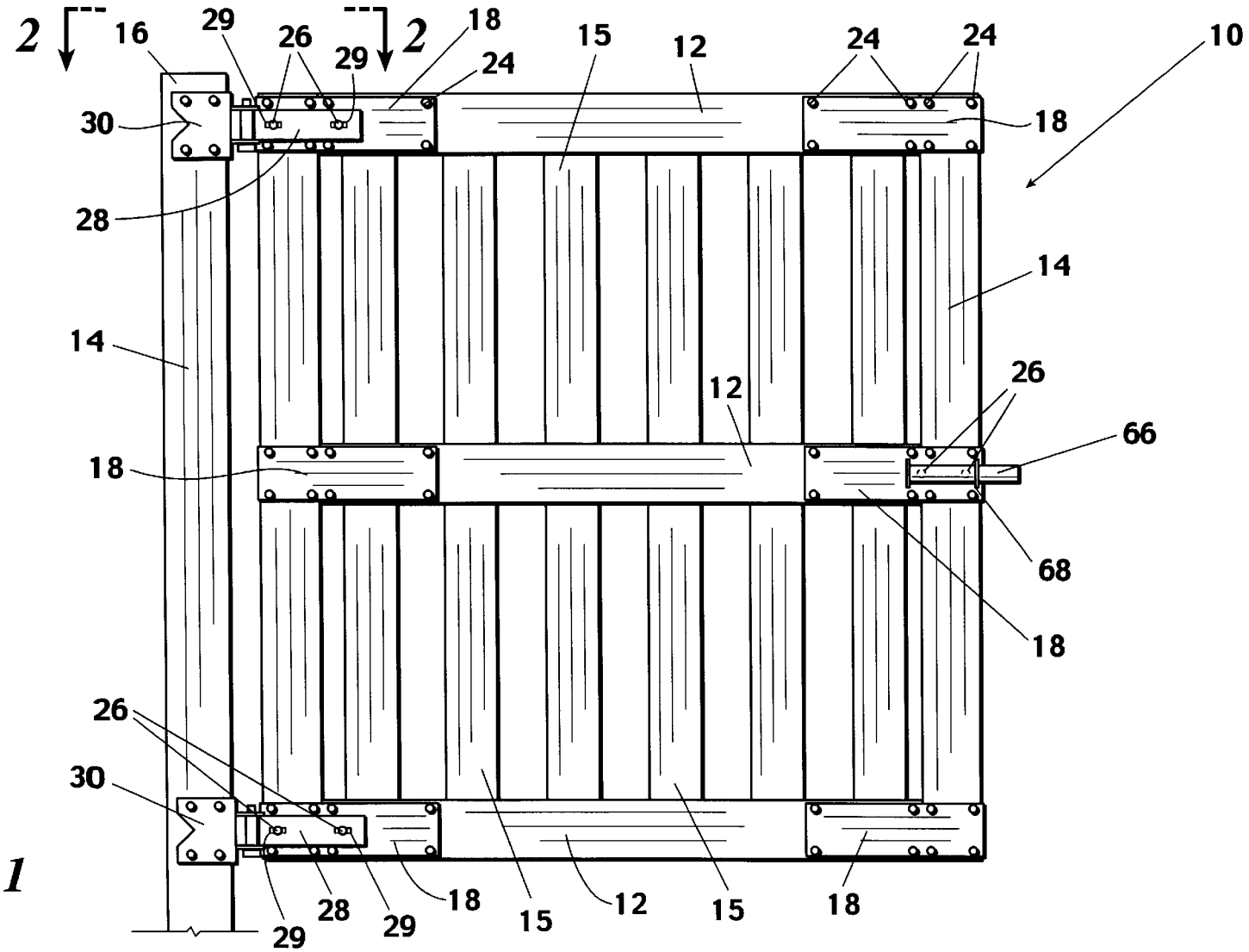
FIG. 1 is a front elevation of a PVC gate mounted for swinging movement on a PVC post.

Referring to the drawings in detail, FIG. 1 shows a PVC gate 10 formed from three horizontal PVC frame members 12 and two PVC vertical frame members 14. A plurality of vertical PVC pickets 15 extend from the top horizontal frame member 12 to the bottom frame member 12 in a conventional manner. The left hand side of the PVC gate 10 will be supported from a PVC hinge post 16 by means of hinges and other hardware later to be described. (Except where indicated otherwise, the hardware is preferably of stainless steel).

Figure 4:
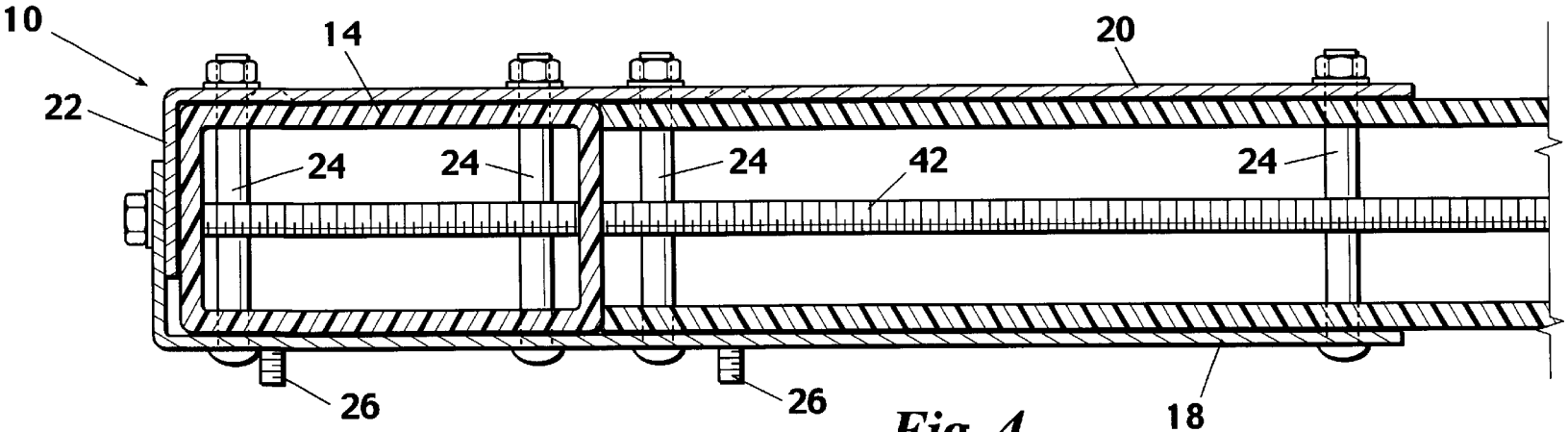
FIG. 4 is a sectional view taken along section line 4—4 of FIG. 3.
Figure 3:
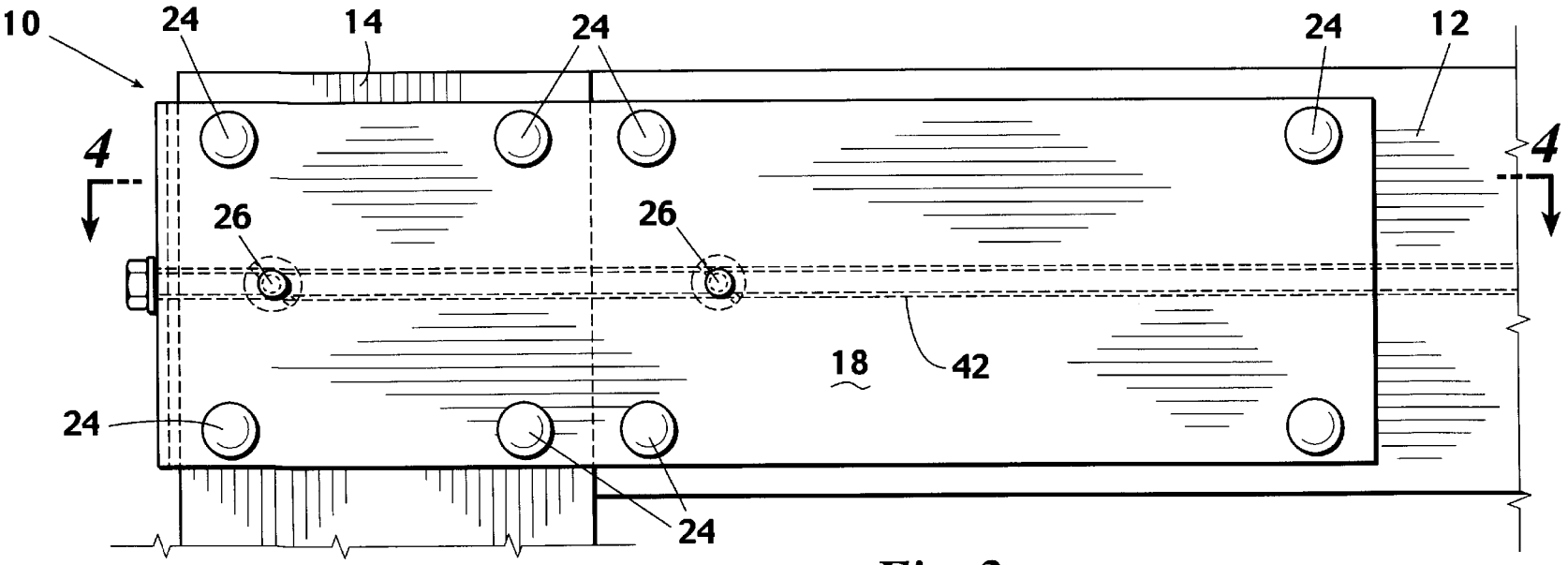
FIG. 3 is a front elevation of the upper portion of the PVC gate shown in FIG. 1.

Referring now to FIGS. 3 and 4, each horizontal end of each horizontal PVC frame member 12 is covered (or enclosed) by a pair of overlapping L shaped framing brackets 18 and 20 which are preferably made of stainless steel. The ends of the gate framing brackets 18 and 20 overlap as at 22. The gate framing brackets 18 and 20 are pre-drilled so as to provide for eight stainless steel carriage bolts 24, four of which pass through the vertical PVC member 14 and four of which pass through the horizontal PVC member 12. The ends of the carriage bolts 24 are secured by suitable nuts as shown. The carriage bolts 24 are tightened so that the PVC gate consisting of the horizontal frame member 12 and the vertical frame member 14 are squeezed between the two gate framing brackets 18 and 20. The framing bracket 18 is also provided with a pair of holes (not numbered) in which a pair of stud bolts 26 are welded and which project out from one side for a purpose which will hereinafter appear.

Figure 2:
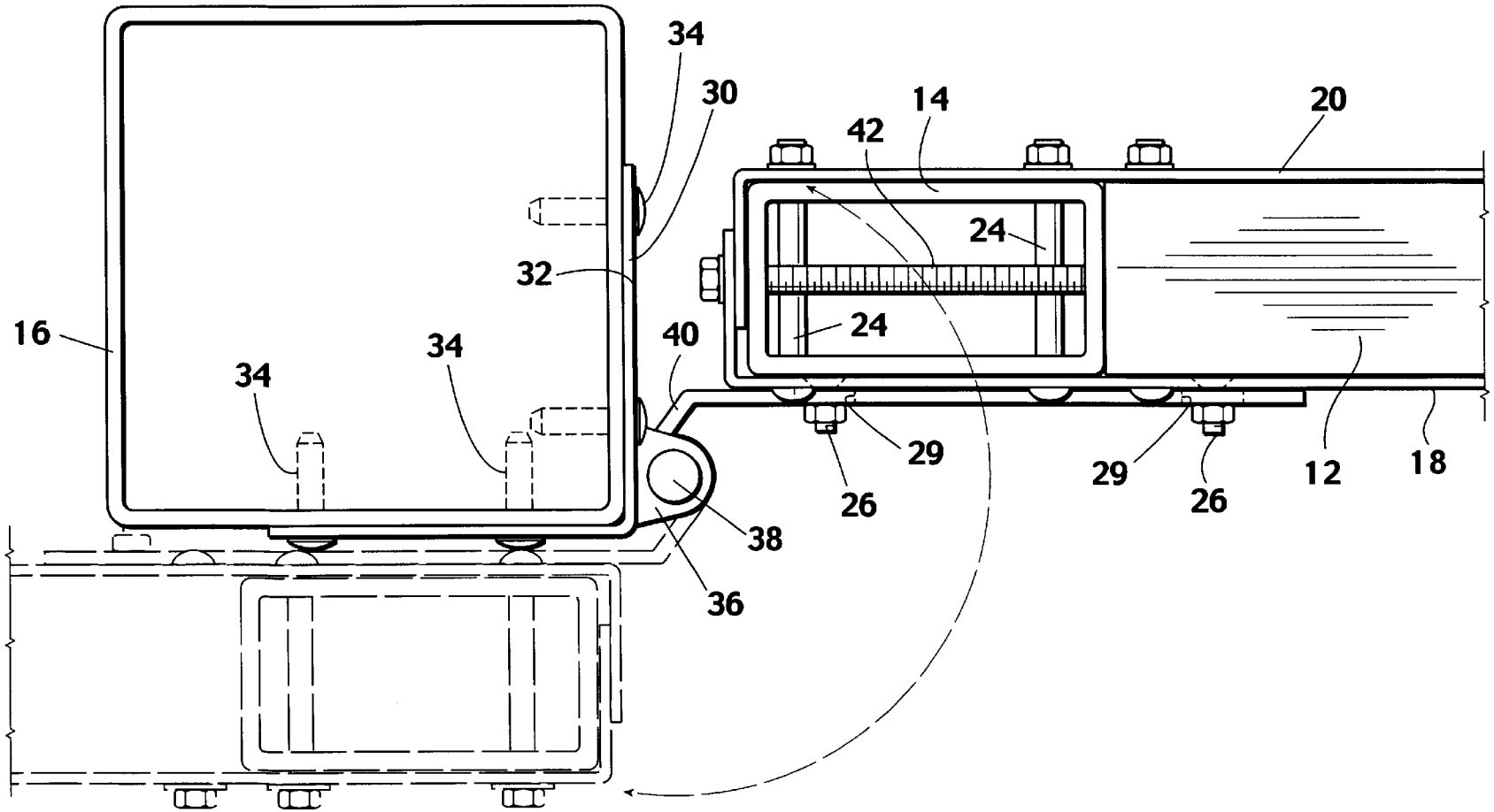
FIG. 2 is a view taken along line 2—2 of FIG. 1.

As best shown in FIG. 2, a hinge strap 28 of a stainless steel hinge 30 is received over the ends of the welded stud bolts 26 and secured in position by means of nuts received on the ends of the stud bolts 26. The hinge strap 28 is provided with two elongated holes or slots 29 through which the stud bolts 26 project. The purpose of the slotted openings is to permit adjustment of the hinge strap 28 in relation to the framing bracket 18. That is, if it is desired to move the PVC gate 10 closer to, or farther away from, the gate post 16, the nuts (not referenced) on the ends of the bolts 26 are loosened and tightened until the proper relationship is established. The hinge 30 is comprised of a right angle member 32 which is secured to two sides of the PVC post by means of suitable screws 34. The portion of the right angle member 32 which is closest to the PVC gate 10 is provided with a pair of ears 36 which support a vertical pivot pin 38. The left hand end of the hinge strap 28 is bent at 40 and is provided with a curved portion (not shown) which is received between the ears 36 and through which the pivot pin 38 is received. By virtue of the offset relationship as provided by the bent portion 40 in relation to the ears 36, the PVC gate 10 can swing a full 180 degrees with respect to the PVC post 16 as shown in dotted lines in FIG. 2.

Returning now to FIGS. 3 and 4, a horizontal post-tensioning rod 42 is provided to extend from the upper left hand corner of the PVC gate 10 to the upper right hand corner thereof. The left hand end of the post-tensioning rod 42 will extend through the overlapping portions 22 as shown but the right hand end will extend likewise through the overlapping portion 22 (not shown in FIG. 4) and be held in position by means of a nut (not shown). A similar post-tensioning rod 42 will extend across from the lower left hand corner of the PVC gate 10 to the lower right hand corner thereof and substantially the same manner as described above in relation the upper rod 42. The post-tensioning rods 42 hold the PVC gate 10 somewhat rigid and prevent it from sagging. A lower hinge 30 will connect the left hand end of the lowermost horizontal PVC frame member 12 to the PVC post 16 by means of a hinge strap 28 which is associated with the lower gate framing bracket 18 in the same manner as described above.

As far as the right hand portion of the PVC gate is concerned, only the center framing bracket 18 will be provided with a pair of stud bolts 26 welded thereto and projecting outwardly. However, the stud bolts 26 on the center right hand framing bracket 18 will be somewhat closer together and will project through the bracket striker bar support as will hereinafter appear.

Figure 6:
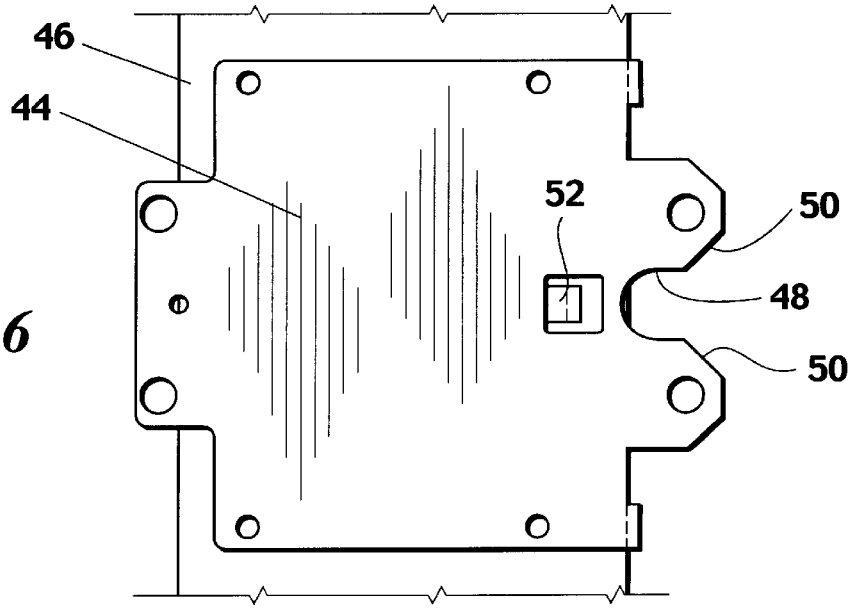
FIG. 6 is a side view of a back plate attached to the PVC post that supports the latch.
Figure 7:
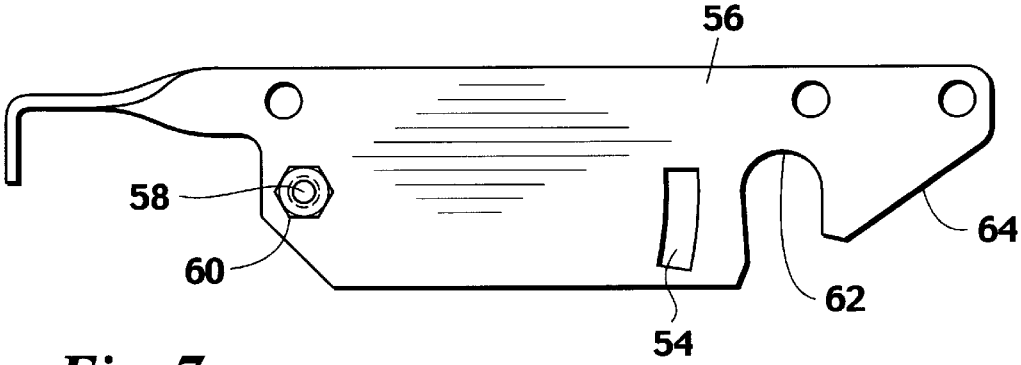
FIG. 7 is a side elevation view of a pivotal latch member adapted to work with the back plate shown in FIG. 6.

Referring now to FIGS. 6 thru 12, these Figures show the latching mechanism for the right side of the PVC gate 10 shown in FIG. 1. FIG. 6 shows a back plate 44 which is attached to the side of a PVC post 46 which would be essentially identical to the post 16 shown in FIG. 1 but which would be located at the opposite side of the PVC gate 10. The back plate 44 is preferably made of stainless steel and is provided with a horizontally oriented opening 48 for receiving a striker bar 66 therein. The portion of the back plate 44 forward of the opening 48 is provided with inclined edges 50 to facilitate the movement of the striker bar 66 into the opening 48. The back plate 44 is also provided with a lug 52 which is bent outwardly from the face of the back plate 44 and which is received in an arcuate slot 54 in a pivotal latch member 56 which is also preferably of stainless steel. The pivotal latch member is pivoted to the back plate 44 by means of a bolt 58 and a nut 60 which is received on the end of the bolt. The right hand end (as it appears in FIG. 7) of the pivotal latch member 56 is provided with a downwardly directed and vertically oriented opening 62 for receiving the striker bar 66 therein. The portion of the pivotal latch member 56 forward of the opening 62 is provided with an inclined surface 64 such that when the striker bar contacts this inclined portion, it will pivot the latch member so that the striker bar will go into the openings 62 and 48. The latch consist of members 44 and 56 is disposed at right angles to the PVC gate 10.

Figure 10:
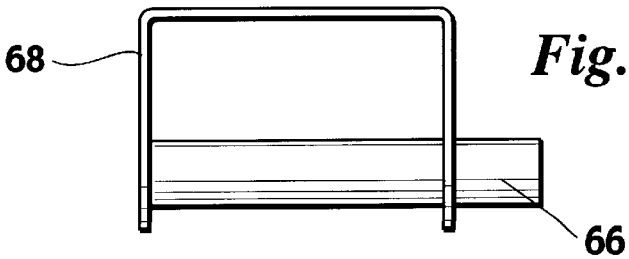
FIG. 10 is a top plan view of the gate latch striker bar and associated support as shown in FIG. 5.
Figure 11:
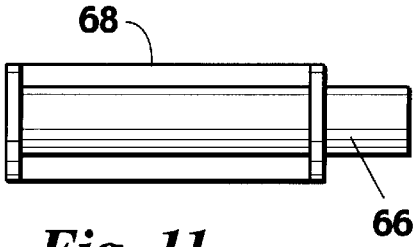
FIG. 11 is a front elevation view of the striker bar shown in FIG. 10.
Figure 12:
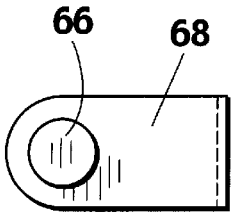
FIG. 12 is a right hand end view of the striker bar shown in FIG. 11.
Figure 8:
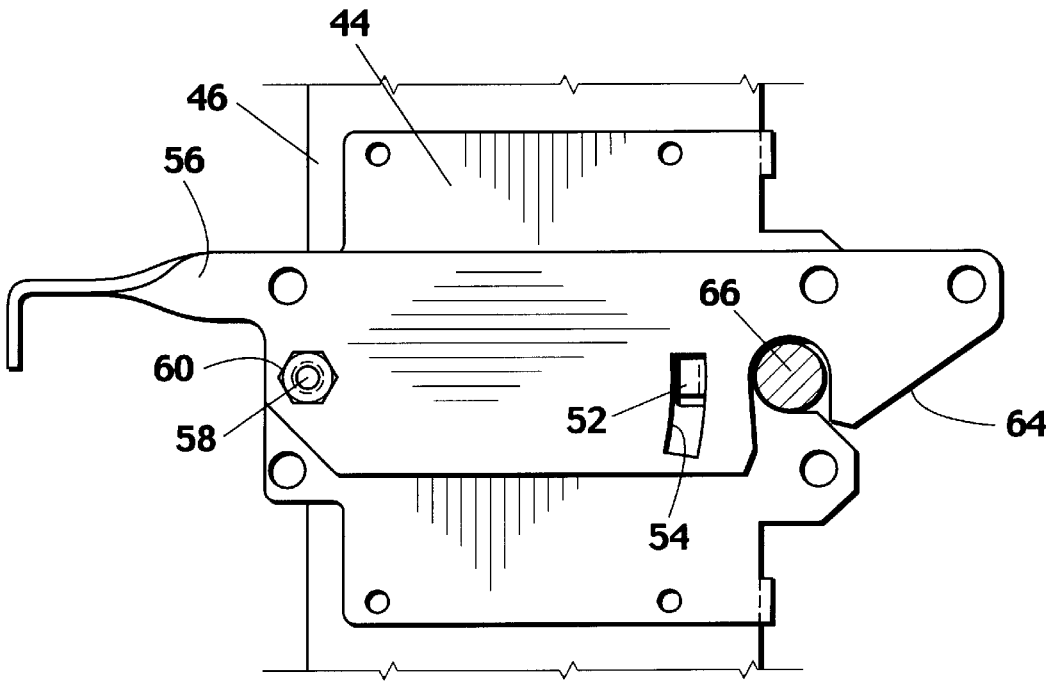
FIG. 8 is a view of the pivotal latch member of FIG. 7 and the back plate of FIG. 6 in assembled and closed position.
Figure 9:
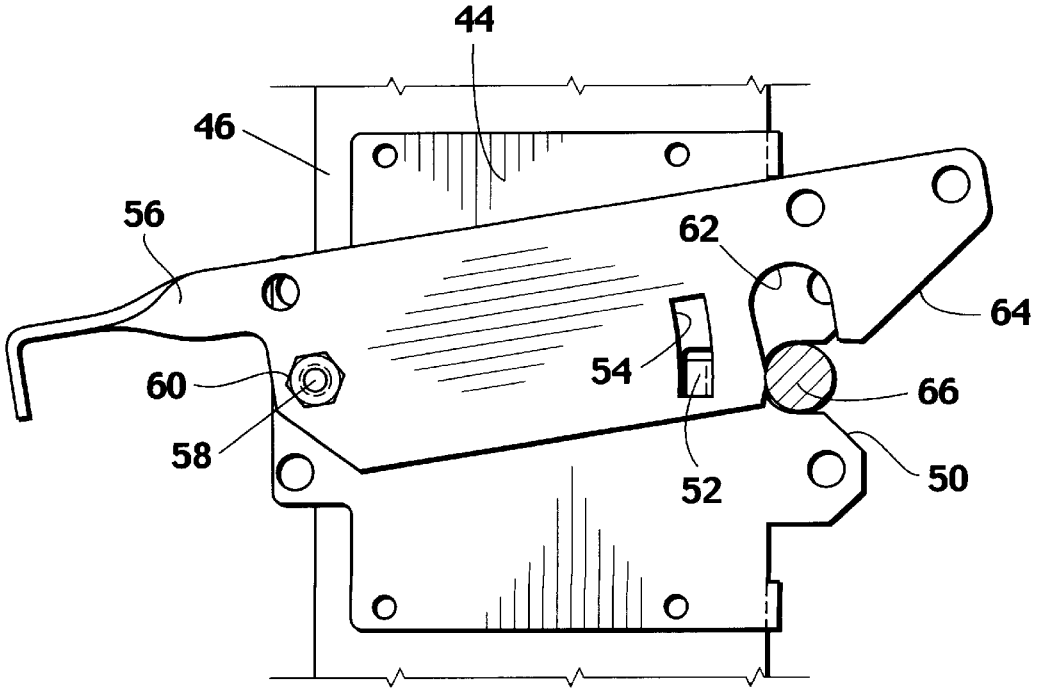
FIG. 9 is a view similar to FIG. 8 but showing the pivotal latch member in an open position.

As shown in FIG. 10, the striker bar consists of a horizontal rod 66 which is supported by a U shaped striker bar support 68.

Figure 5:
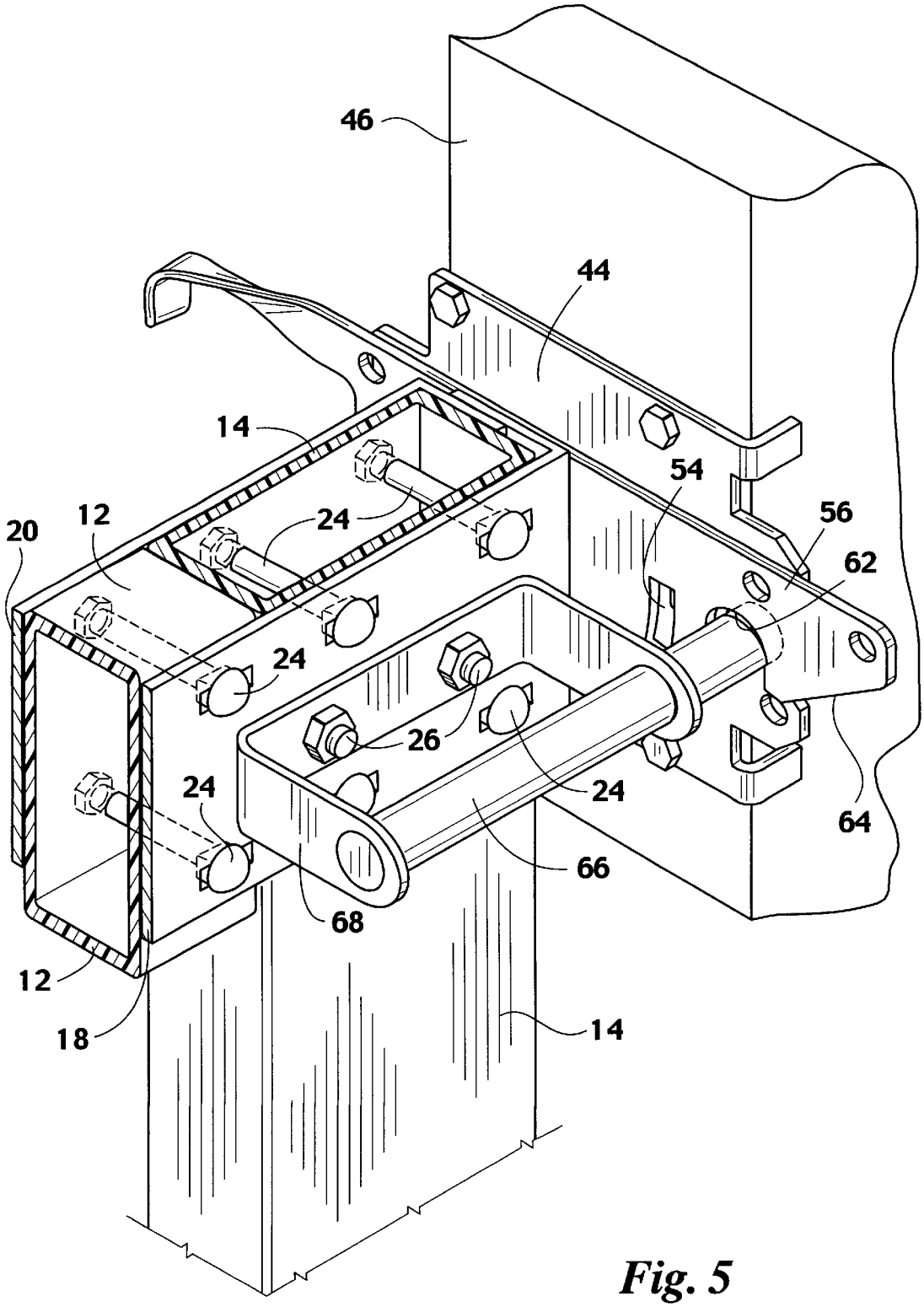
FIG. 5 is a perspective view, with some parts in section, of the central right hand portion of the gate shown in FIG. 1, and showing additional features of a latch.

As best shown in FIG. 5, the U shaped striker bar support 68 is connected to the right hand center gate framing bracket 18 by means of a pair 6f stud welded bolts 26, in much the same manner that the hinge straps 28 are connected to the upper and lower left hand framing brackets 18. The striker bar support 68 supports the striker bar 66 in spaced parallel relation with the right hand vertical PVC frame member 14 such that the striker bar 66 can be used as a handle to open and close the PVC gate 10.

What is claimed is:

1. A gate framing system in combination with a PVC gate, the gate comprising first and second vertical PVC frame members connected at upper and lower ends thereof to first and second horizontal PVC frame members, the vertical PVC frame members being spaced from each other and constituting side members of the gate, the horizontal PVC frame members being spaced from each other and constituting top and bottom members of the gate, the connections of the vertical PVC frame members to the horizontal PVC frame members forming four corners on the PVC gate, the gate being further defined as having a front side and rear side, the framing system comprising a pair of spaced metallic framing brackets mounted at each said corner of the PVC gate such that one of said framing brackets at each said corner lies along the rear side of the PVC gate and the other of said framing brackets at each said corner lies along the front side of the PVC gate, the pairs of framing brackets being connected to each other by means of holding the PVC gate in compression at each corner thereof to increase the strength and rigidity of the PVC gate, a pair of metallic hinge brackets each connected directly to a respective one of the pairs of framing brackets disposed along the first vertical PVC frame member.

2. A gate framing system in combination with a PVC gate as set forth in claim 1, wherein each pair of spaced metallic framing brackets are designed to sandwich said vertical PVC frame member and the horizontal PVC frame member forming a respective one of said corners.

3. A gate framing system in combination with a PVC gate as set forth in claim 1, wherein the PVC gate is adapted to be hingedly connected to a PVC gate hinge post, wherein each hinge bracket constitutes a portion of a hinge, each hinge also including a right angled member which is adapted to be secured to two sides of the PVC gate hinge post adjacent a respective one of said hinge brackets, each right angled member being provided with a pair of ears which support a pivot pin, each hinge bracket being provided with a bent portion, the bent portion of each hinge bracket being provided with a curved portion at an end thereof through which a respective one of the pivot pins is received, thereby providing an offset relation between the hinge brackets and the right angled members whereby the gate can swing through 180 degrees of movement with respect to the PVC hinge post.

4. A gate framing system in combination with a PVC gate, the gate comprising first and second vertical PVC frame members connected at upper and lower ends thereof to first and second horizontal PVC frame members, the vertical PVC frame members being spaced from each other and constituting side members of the gate, the horizontal PVC frame members being spaced from each other and constituting top and bottom members of the gate the connections of the vertical PVC frame members to the horizontal PVC frame members forming four corners of the PVC gate, the gate framing system comprising a pair of metallic framing brackets mounted at each corner of the PVC gate, each pair of framing brackets at each corner being bolted to each other to hold PVC gate in compression between the brackets, wherein the framing brackets of each said pair of framing brackets are bent around the outer side edges of a respective one of the PVC vertical frame members and overlap one another, wherein a first post-tensioning metallic rod extends horizontally across the top of the PVC gate between the overlapping pairs of brackets at the upper corners of the PVC gate, and wherein a second post-tensioning metallic rod extends horizontally across the bottom of the PVC gate between the overlapping pairs of framing brackets at the bottom corners of the PVC gate, whereby the post-tensioning rods exert horizontal compressive forces between the upper corners and the bottom corners to add structural rigidity to the PVC gate.

5. A gate framing system in combination a PVC gate, the gate comprising first and second vertical PVC frame members connected at upper and lower ends thereof to first and second horizontal PVC frame members, the vertical PVC members being spaced from each other and constituting side members of the gate, the horizontal PVC frame members being spaced from each other and constituting top and bottom members of the gate, the connections of the vertical PVC frame members to the horizontal PVC frame members forming four corners of the PVC gate, the gate being further defined as having a front side and rear side, the framing system comprising a pair of spaced metallic framing brackets mounted at each said corner of the PVC gate such that one framing bracket of each said pair of framing brackets lies along the rear side of the PVC gate and the other framing bracket of each said pair of framing brackets lies along the front side of the PVC gate opposite the one framing bracket, the brackets of each pair of framing brackets being connected to each other in such a manner as to hold the PVC gate in compression between the brackets, a pair of metallic hinge brackets each connected directly to a respective one of pairs of framing brackets disposed along the first vertical PVC frame member, wherein the faming brackets of each said pair of framing brackets are bent around a respective one of the PVC vertical frame members and overlap one another and wherein a first post-tensioning metallic rod extends horizontally across the top of the PVC gate between the pairs of brackets at the upper corners of the PVC gate and through the overlapping framing brackets disposed at the upper corners of the PVC gate, a second post-tensioning metallic rod extending horizontally across the bottom of the PVC gate between the pairs of framing brackets at the bottom corners of the PVC gate and through the overlapping framing brackets disposed at the bottom corners of the PVC gate, the post-tensioning rods exerting horizontal compressive forces between the upper corners and the bottom corners to add structural rigidity to the PVC gate.

6. A gate framing system in combination with a PVC gate, the gate comprising first and second vertical PVC frame members connected at upper and lower ends thereof to first and second horizontal PVC frame members, the vertical PVC members being spaced from each other and constituting side members of the gate, the horizontal PVC frame members being spaced from each other and constituting top and bottom members of the gate, the connections of the vertical PVC frame members to the horizontal PVC frame members forming four corners of the PVC gate, the gate being further defined as having a front side and rear side, the framing system comprising a pair of spaced metallic framing brackets mounted at each said corner of the PVC gate such that one framing bracket of each said pair of framing brackets lies along the rear side of the PVC gate and the other framing bracket of each said pair of framing brackets lies along the front side of the PVC gate opposite the one framing bracket, the brackets of each pair of framing brackets being connected to each other in such a manner as to hold the PVC gate in compression between the brackets, a pair of metallic hinge brackets each connected directly to a respective one of the pairs of framing brackets disposed along the first vertical PVC frame member, wherein the PVC gate is adapted to be hingedly connected to a PVC gate hinge post, wherein each hinge bracket constitutes a portion of a hinge, each hinge also including a right angled member which is adapted to be secured to two sides of the PVC hinge post adjacent a respective one of said hinge brackets, each right angled member being provided with a pair of ears which support a pivot pin, each hinge bracket being provided with a bent portion, the bent portion of each hinge bracket being provided with a curved portion at an end thereof through which a respective one of the pivot pins is received, thereby providing an offset relation between the hinge brackets and the right angled members whereby the gate can swing through 180 degrees of movement with respect to the PVC hinge post, wherein the PVC gate is adapted to engage a PVC latch post disposed along said second vertical PVC frame member, the PVC gate being provided with an intermediate PVC frame member positioned between and parallel with the horizontal PVC frame members, said intermediate PVC frame member being connected at its ends to the first and second vertical PVC frame members, a pair of intermediate metallic framing brackets connecting a respective one of said ends of the intermediate PVC frame member to the second vertical PVC frame member and holding portions of the PVC gate in compression between the intermediate metallic framing brackets, a U shaped striker bar support connected to one of said intermediate metallic framing brackets on the front side of the PVC gate, a striker bar mounted on the striker bar support in spaced parallel relation with the PVC gate, a metallic back plate adapted to be mounted on one side of the PVC latch post adjacent to the striker bar, a metallic pivotal latch member pivotally mounted on the back plate, the back plate being provided with a horizontally oriented opening for receiving the striker bar therein, portions of the back plate adjacent of the horizontally oriented opening being provided with inclined edges to facilitate movement of the striker bar into the opening, the pivotal latch member being provided with a downwardly directed and vertically oriented opening for receiving the striker bar therein when the striker bar is also received in the horizontally oriented opening of the back plate, the pivotal latch member being provided with an inclined surface adjacent the vertically oriented opening such that, when the striker bar contacts the inclined surface, said stricker bar can pivot the latch member so that the striker bar will go into said openings, the striker bar being spaced from the front side of the PVC gate such that said stricker can be used as a handle to pivot the PVC gate.

* * * * *